US005135366A

United States Patent [19]

Ribeiro

[11] Patent Number: 5,135,366

[45] Date of Patent: Aug. 4, 1992

[54] SELECTIVE VALVE TO PASS FLUIDS

[75] Inventor: Marcos P. Ribeiro, Rio de Janeiro, Brazil

[73] Assignee: Petroleo Brasileiro S.A., Rio de Janeiro, Brazil

[21] Appl. No.: 746,534

[22] Filed: Aug. 19, 1991

Related U.S. Application Data

[63] Continuation-in-part of Ser. No. 449,213, Dec. 12, 1989, Pat. No. 5,054,510.

[51] Int. Cl.[5] ..... F04B 47/00

[52] U.S. Cl. ..... 417/435; 137/199

[58] Field of Search ..... 417/435; 137/199, 197, 137/565

[56] References Cited

U.S. PATENT DOCUMENTS

| | | | |
|---|---|---|---|
| 2,908,282 | 10/1959 | Maisch | 137/199 |
| 3,031,845 | 5/1962 | Ludwig | 137/199 X |
| 3,081,788 | 3/1963 | Lewis | 137/199 X |
| 3,861,471 | 1/1975 | Douglas | 417/435 X |
| 4,490,095 | 12/1984 | Soderberg | 417/435 X |

*Primary Examiner*—Alan Cohan

*Attorney, Agent, or Firm*—Sughrue, Mion, Zinn, Macpeak & Seas

[57] ABSTRACT

Selective valves to pass fluids consisting of a body and a housing, provided with a midway communicating passage in which is placed a dynamically governed mechanical system able to separate gases from fluids compressed by a subsurface oilfield pumps. The mechanical system utilizes a pair of half-shells, a ball or equivalent, provided with or acting on a roughness controlled surface which allows only a gas to pass.

3 Claims, 3 Drawing Sheets

FIG. 1
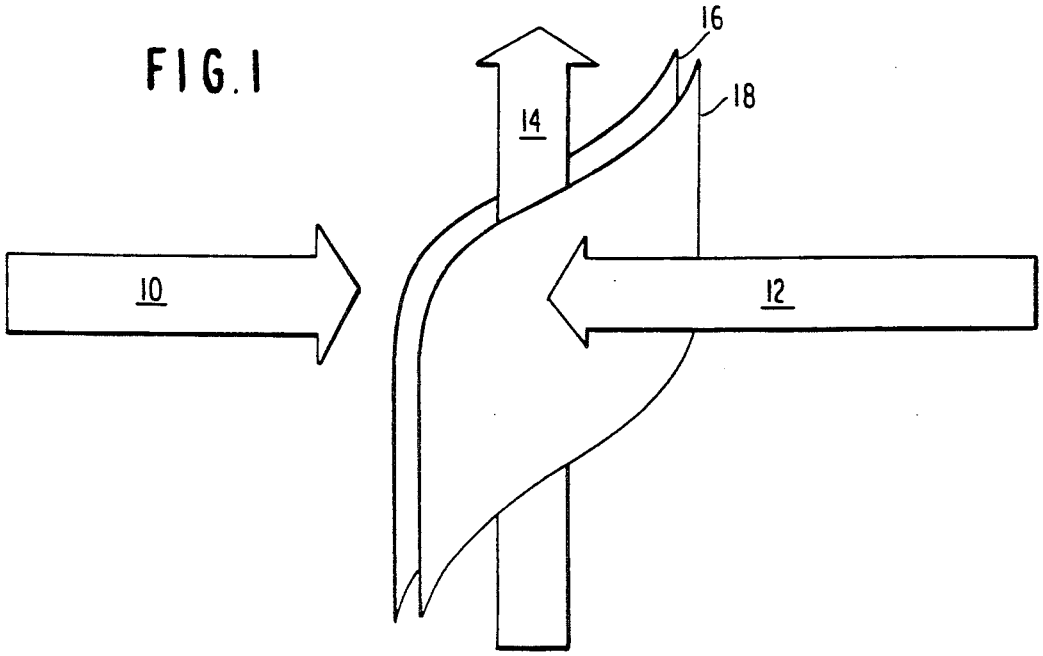
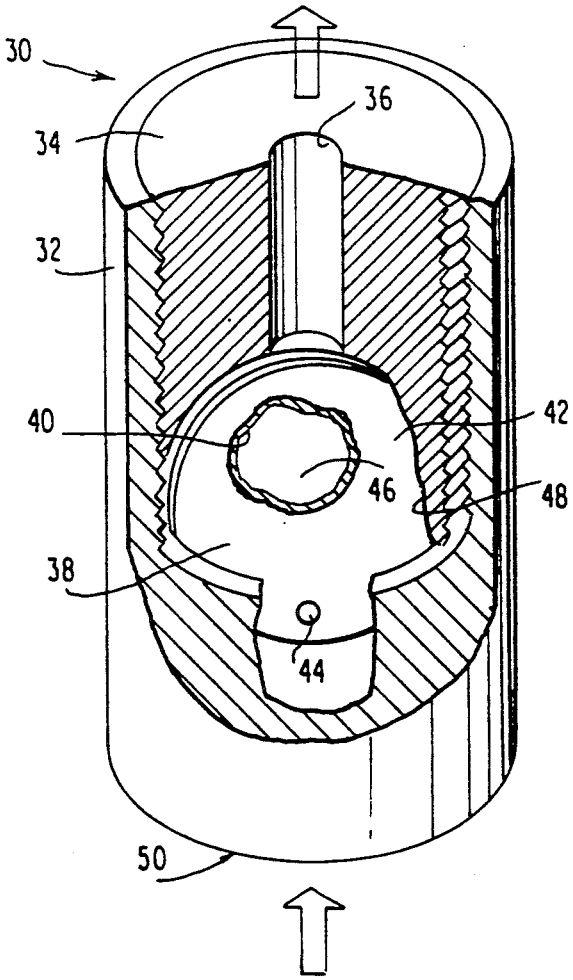
FIG. 2

FIG.5
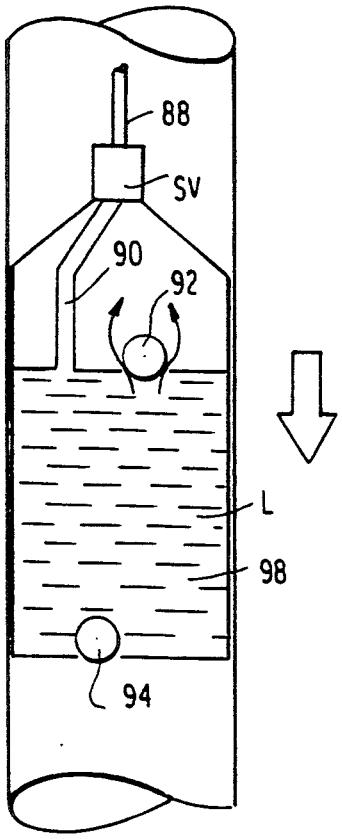
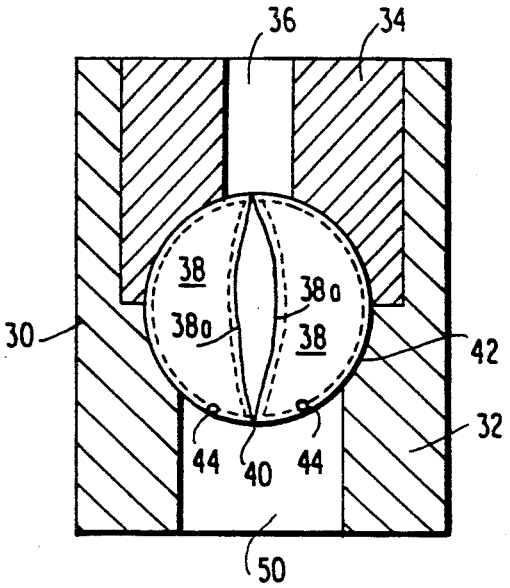
FIG.6A
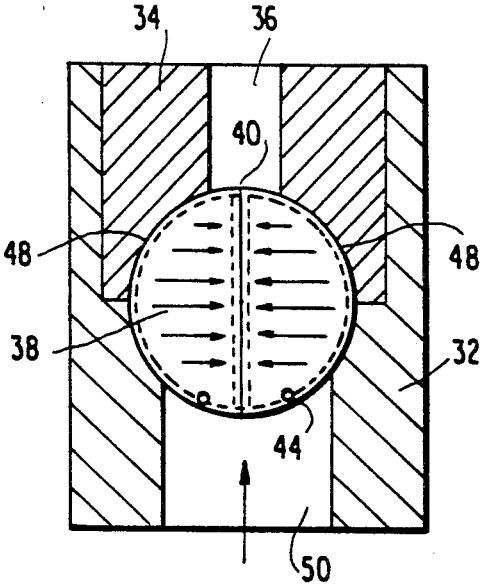
FIG.6B

SELECTIVE VALVE TO PASS FLUIDS

This application is a continuation-in-part of application Ser. No. 07/449,213, entitled "SELECTIVE VALVE TO PASS FLUIDS", filed Dec. 12, 1989, now U.S. Pat. No. 5,054,510, issued Oct. 8, 1991.

FIELD OF THE INVENTION

This invention refers to selective valves to pass fluids, said valve being used in the separating of low viscosity and low surface tension fluids, such as a gas, inside fluid pumps during the compression of liquids in general.

The selective valves to pass fluid, of the present invention are used to solve gas lock in sucker rod pumps, when a substantial quantity of gas fills the inside of the pump. Since gas is highly compressible the travelling valve does not open on the downstroke, because the pressure of the column of fluid above the valve is greater than the pressure of the gas compressed within the pump.

BACKGROUND OF THE INVENTION

A major trouble to be overcome in the conventional types of subsurface oilfield pumps is technically known as a "gas lock". It occurs when the incoming pressure in the tubing is kept up by the orifice outlet valve, or travelling valve, on the upstroke of the piston, and by the orifice inlet valve, or standing valve, on the downstroke of the piston. This downstroke of the travelling valve gives rise to pressure within the fluid between the travelling and standing valves, and causes the travelling valve to open, thus enabling fluid to pass through the travelling valve or orifice outlet valve.

However, when operating in a well that is producing both oil and gas at the same time, the chamber placed between the travelling valve and the standing valve is often filled with gas, and, due to the compressibility of the gas, the downstroke of the travelling valve may not create enough pressure in the chamber below the aforesaid valve to offset the pressure of the column of fluid standing above the valve. As a consequence, the travelling valve remains closed throughout the downstroke. Therefore, the gas between the standing valve and the travelling valve only compresses and expands at every stroke of the piston, which leads to a pump operating defect known as "gas lock", a state of affairs which may go on indefinitely.

The Brazilian patent application PI 8501271 of Mar. 19, 1985 concerns a system meant to solve the troubles referred to above. It consists of an elongated housing containing a first valve fitted into the bottom end of the housing; a part to drive a travelling valve fitted in the upper end of the housing, said part placed so as to slide lengthways in relation to the housing; and a rotating travelling valve fitted between the first valve and the part that drives the travelling valve. The travelling valve possesses upper and lower ends and a sealing surface against either end; a piston to compress fluids, lying between the first valve and the part that drives the travelling valve; and a means to rotate the travelling valve around its lengthwise axis. Said rotating means is connected to the part that drives the travelling valve and the travelling valve itself, whereby the lengthwise movement of the part that drives the travelling valve causes the travelling valve to rotate. The first valve is actuated by fluid pressure variations, which take place inside the housing, while the travelling valve and the part that drives the travelling valve is operated mechanically.

Regarding performance in the foregoing system, one notes that gas locks, hydraulic chock and sealing defects caused by vibration of pump piston are avoided. The same does not apply to wear, since there is no way of ensuring that particles of dirt may not get into the travelling valve assembly. If this does happen, there may occur serious trouble, not only regarding wear but also locking and breaking thereof. If particles store in the joints, this may be enough to bring about locking. Since it is mechanically operated, considerable forces are exerted upon the helical part, which is the most fragile part in the system.

Positive displacement action pumps are also used in the prior art. Throughout pump discharge, the standing valve remains closed and the piston moves from its furthest position to its closest position relative to the standing valve. When this happens, the piston tends to stay in the same place due to the effect of friction between the piston and the pump body, as well as because of the effect of the counter-pressure created between the travelling and the standing valves, as the pump moves towards the standing valve. At the same time, all the weight of the pump rods are bearing directly on the plug, forcing it to be pushed off the valve seat. This forced opening promptly prevents any gas or vapor lock from taking place.

When the valve opens, the distance between the seat and the plug is limited by a stem that joins the plug to the connection. This distance is calculated beforehand in such a way as to enable the fluid to flow forward of the opening under less resistance.

As soon as the piston gets to the point closest to the standing valve, it acts in the opposite direction, into its initial suction stroke. Again, friction between the piston and the pump body tends to hold the piston back until the plug seals against its seat. This takes place when the relative speed of the fluids at either side of the valve is null, therefore the effect of any erosion upon sealing surfaces is considerably less.

When the travelling valve is closed, the pressure between the travelling and the standing valves is reduced as the piston moves off from the standing valve, until it becomes lower than the pressure in the reservoir. When this occurs, the standing valve opens and lets fluid in from the reservoir into the pump body. Finally, when the piston gets to its point furthest away from the standing valve, the piston moves in the opposite direction and the pumping cycle is repeated.

However, a disadvantage of the aforesaid system is that particles of dirt storage may prevent operation from being the ideal, since the relative movement of any fluid bearing particles of sand in suspension erodes the sealing portions of ball or piston valves (particularly in the case of the travelling valve) because of rubbing by particles of silica which is present in any kind of sand.

Another disadvantage is that it is difficult to make use of existing pistons, since not just any kind of piston may be used, and also there is the end cost of the equipment to be considered.

SUMMARY OF THE INVENTION

This invention introduces the use of selective valves for fluids that allow only gas to pass, and without any changing in the pump action. Such selective valves will act only when pressure is low inside the pump and when viscosity and surface tension of the fluid are low, a characteristic of gases in general.

Fluids within a pump (gas or liquid), and in the tubing, are separated by an opening or gap dynamically governed by the pressure inside the pump, said opening or gap allows only fluids of low surface tension and viscosity (such as gases) to pass.

This invention refers to a selective valve to pass fluids to be used with subsurface oilfield pumps, in which the valve goes into action only when pressure is low inside the pump, thereby enabling only fluids of low surface tension and viscosity to pass. Said selective valve is provided with separating means inside which consists of openings or gaps dynamically governed by the pressure inside the pump and is placed in connection with the pump and the tubing.

In an alternative embodiment of this invention, the selective valve to pass fluids consists of a body and a housing enveloping a pair of shells, both body and housing possessing a midway communicating passage.

Within the selective valve there are two shells, made of a flexible material, which seals the midway passage at the points where the external surface of the shells touch each other. In the middle and lower parts of the shells there are openings which contact the fluid compressed by the pump through the midway communicating passage.

In a second alternative embodiment of the invention, the selective valve consists of a body and a housing forming a midway communicating passage, containing a smooth ball inside. The internal seats in the middle of body possess a surface which touches the ball of a suitable shape for controlling purposes (for instance, both of calculated roughness and shape). The lower part of the communicating passage provides a sealing surface and contacts the fluid compressed by the pump.

Other features and advantages of the selective valves to pass fluids of the present invention will now become more clear from the detailed description in connection with the drawings that follows.

BRIEF DESCRIPTION OF THE DRAWINGS

FIG. 1 is a perspective view which illustrates schematically the principle of functioning of the dynamically governed mechanical system inside the selective valves of this invention;

FIG. 2 is a perspective view of an alternative embodiment of the selective valve of this invention;

FIG. 5 is a sectional view similar to that of FIG. 4 under conditions in which a liquid fills the hollow piston during the downstroke of the piston pump;

FIG. 6A is a vertical sectional view of the selective valve of FIG. 2; and

FIG. 6B is a similar sectional view to that of FIG. 6A illustrating the effect of fluid pressure generated forces within the hollow half spheres during the downstroke of the pump.

DESCRIPTION OF THE PREFERRED EMBODIMENTS

As stated before, the purpose of the selective valve for the flow of fluids is to prevent gas locks in the pumping of fluids in general. This phenomenon occurs whenever there is a considerable quantity of gas inside the pump. Since gas is highly compressible, the travelling valve used in the tubing does not open on the downstroke because the pressure of the column of fluid standing above is greater than the pressure of the gas compressed inside the pump.

One solution to overcome the problem consists of using a selective valve that lets only gas pass without change of the pumping function. The valve should act only when pressure inside the pump is low, as well as viscosity and surface tension of the fluid. These properties are usually found in gases in general.

The principle on which such valve operates is that the fluids inside the pump (gas or liquid) and those in the tubing should be separated by means of an opening or gap dynamically governed by the pressure inside the pump, through the opening or gap only very low surface tension and viscosity fluids (such as gas) may pass.

FIG. 1 shows in a schematic way this principle. Arrows 10 and 12 represent the pressure within the pump, and arrow 14 represents the controlled passage of gas through a gap or opening between two walls 16 and 18. These walls are provided with suitable shape and possess a controlled roughness surface, which are a function of the viscosity and surface tension of the gas.

In a liquid containing medium, the small irregularities between the roughened surface will cause a formation of capillary passages which allow gas to escape due to the compressibility, physical properties, low surface tension and low viscosity of the gas but will be maintained by external fluid pressure tight enough to hinder the passage of any liquid therethrough.

Figure 4:
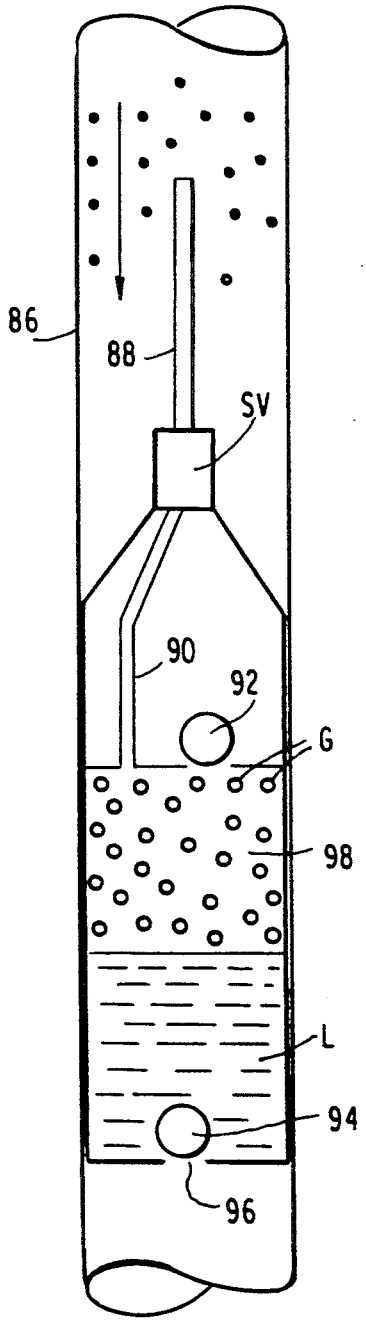
FIG. 4 is an enlarged cross-section view representing the location of the selective valve of this invention, communicating the rod piston with the tubing.

In FIG. 2, the selective valve SV as per FIGS. 4 and 5 is referred to by number 30. It consists of a body 32 and a housing 34, which envelope a pair of hollow half-shells 38. The housing 34 is provided at the top and in the middle with a communicating passage 36 for passing the low surface tension and viscosity fluid (gas). The half-shells 38, placed inside the valve, are made of a flexible material, such as a metal, and are provided with an internal wall **38*a* whose outer surface 40 is of controlled roughness, an external smooth surface 42, as well as openings 44 which allow the fluid to penetrate in the hollow half-shells 38. The high pressure fluid acting within volume 46 leads to a sealing surface area 48 at the point where the half-shells 38 touch the spherical recess 34*a* of housing 34. The midway lower communicating passage 50** opens to the fluid compressed by the pump.

The metal half-shells 38 govern the flow of fluid by means of the pressure of the fluid that comes in through the openings 44. The sealing surface 48, where the shell touches upon the seat is smooth, in order to ensure a good sealing. The contact area of walls **38*a* between half-shells 38** is rough and thick, and the shape (twists) are dimensioned to let only gas to pass.

Figure 3:
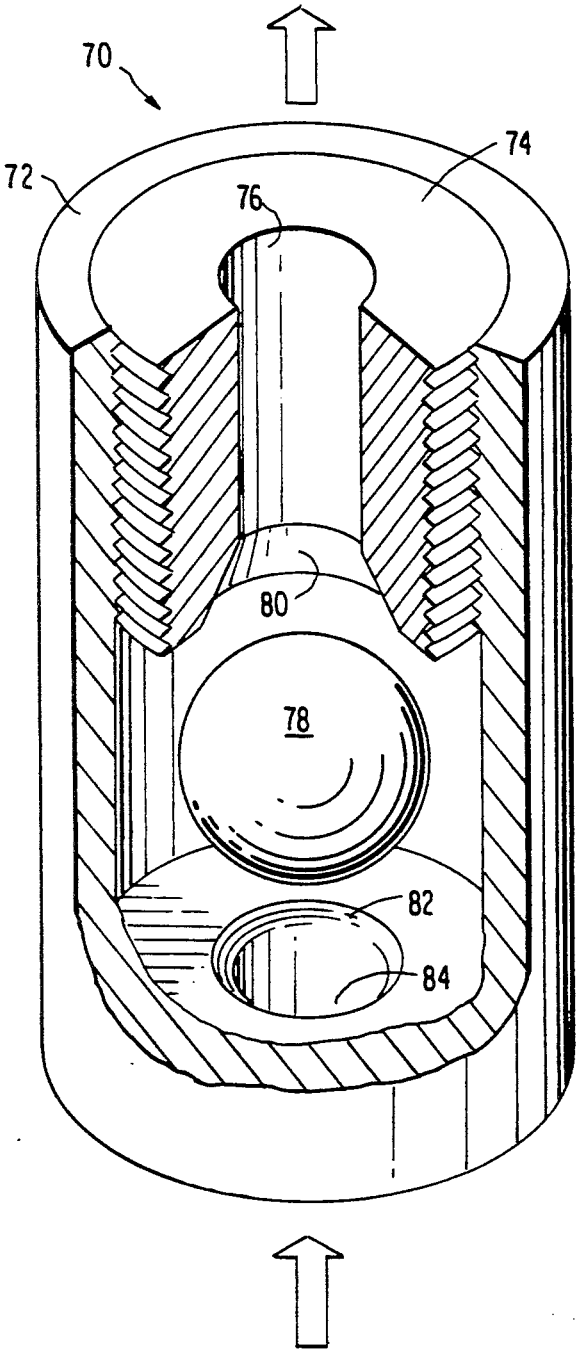
FIG. 3 is a perspective view, partially broken away of a second alternative embodiment of the selective valve of this invention.

FIG. 4 is an enlarged cross-section view showing the location of the selective valve SV of this invention, whether such valve be in accordance with that of FIG. 2 or FIG. 3.

The selective valve SV, according to any of the alternatives 30, 70 referred above, is placed in connection with a vertically reciprocating pumping rod 88 and a communicating passage 90, which leads to the inside of the piston pump 98. In this way, a communication between the piston pump 98 and the outer tubing 86 is reached. A travelling valve 92, a standing valve 94 and the suction-side 96 of the pump 98, all within piston 98*a*, are also shown.

In general, in all embodiments of this invention, on the downstroke, whenever there is a liquid or little gas inside the pump 98, the resulting pressure upon the control walls (38*a*, 80) will be high enough to prevent any fluid (even gas) from passing through the fluid flow control gap. Whenever there is a significant quantity of compressible fluid present inside the pump 98, the resulting pressure exerted upon the control walls 38*a*, 80 will not be enough to prevent any very low viscosity and surface tension fluid from passing into the upper part of the pump (as in the case of gas). This phenomenon occurs because only a liquid with very poor compressibility will quickly and strongly compress the walls, closing them completely.

On the downstroke of piston pump 98, FIG. 5, the piston 98*a* of the pump 98 is completely full with liquid (without gas). The travelling valve 92 is thus opened while the standing valve 94 is closed. The selective valve SV will also be closed.

Assuming that half-shells 38 are hollow half spheres placed together (side-by-side) inside body 32 and housing 34, as shown in FIG. 5, at a moment before the downstroke movement, the half-shells 38 are empty, therefore there does not exist any force acting on the controlled roughness contact surfaces 40 of respective walls 38*a* between the half spheres.

When the piston 98*a* starts to go down, the liquid contained inside the pump moves into passage 90 and enters the midway lower communicating passage 50 and the into openings 44 of the half-shells 38, compressing the controlled roughness surfaces 40 one against the other and closing the passageway between the surfaces 40, FIG. 6B. As a consequence, the liquid will be forced to pass through the travelling valve 92 only.

Under gas lock conditions, the piston 98*a* of the pump 98 is partially filled with gas. The travelling valve 92 remains closed because there is a high pressure above the valve and the gas is easily compressed. The standing valve 94 is also closed, FIG. 4.

When the piston 98*a* starts to go down, gas enters into the shells 38 instead of a liquid. As gas is easily compressed, there will not be sufficient force to compress the half spheres 38 and to close the passageway between them. Therefore, the gas will escape between controlled roughness surfaces 40 and exit passageway 36.

When the piston 98*a* reaches the level of the liquid, it begins to be pumped to the half shells 38, closing the passageway 36 to the liquid (as described above), but allowing any remained gas in mixture with liquid to pass through passage 36, because of the controlled roughness surfaces 40. Thus, the normal operation is restored.

FIG. 3 shows a second alternative embodiment 70 of the selective valve SV. The selective valve is designated by number 70 and consists of a body 72 and sealing seats 74, 74', both provided with respective axial communicating passages 76, 84; passage 76 allowing the low surface tension and viscosity fluid to pass, while passage 84 is open to the fluid compressed by the pump 98. Inside the selective valve 70 there is a ball 78. Sealing seat 74 is provided with a spherical controlled roughness surface 80 in a lower part thereof, about passage 76. The fluid compressed by the pump 98, entering through the passage 84 acts upon the whole area of the ball 78, which lies on the sealing seat 74'. Communicating passage 84 in the lower part of the valve opens, preferably to spherical sealing surface 82.

As can be observed from FIG. 3, the ball 78 and sealing seat 74 surface 80 are shaped and roughness controlled.

It should be pointed out that elements of different geometrical forms such as a plate, a cone, etc. may be employed instead of a ball. Any change made in such parts without modifying the surface control principle is to be regarded as a similar invention.

Concerning the FIG. 3 embodiment, the controlled roughness surface 80 is located on the lower part of the sealing seat 74.

In the normal operation of the pump 98 and when the liquid comes into the selective valve through communicating passage 84 of the lower part of the selective valve 70, ball 78 is pushed against the sealing seat 84, closing the selective valve.

If there is a gas inside the pump, this gas comes into the selective valve 70 but does not possess sufficient pressure to close completely the passage 76 due to the controlled roughness of at least surface 80. Thus, the gas G will escape through said passage 76. When liquid begins to be pumped by pump 98, then the normal functioning is restored, as disclosed above.

As mentioned according to the FIG. 3 embodiment, the sealing element can be other than a ball, e.g. a plate, a cone, etc. In this case, the shapes of the sealing seats 74, 82 and that of the ball, plate, cone, etc. shall be proper to allow a perfect sealing of the passages 76, 84, i.e. conical to conical, spherical to spherical, etc. The passage from which the gas can escape must possess at least one of the contact surfaces of a type having a controlled roughness surface.

What is claimed is:

1. A selective valve to pass fluids for a subsurface oilfield pump within a column without a gas lock, said selective valve comprising a means inside the pump and the column for gas and liquid separating purposes, said means comprising a pair of juxtaposed members defining opposing contacting surfaces forming a gap therebetween, at least one of said opposing contactable surfaces having a predetermined surface roughness, means for applying pump fluid pressure against at least one of said members to press said members into contact with each other such that said gap constitutes a fluid control gap, and wherein said members including said surface of predetermined roughness at least partially forming said fluid flow control gap are dynamically governed by the subsurface oilfield fluid pressure inside the pump, whereby said selective valve acts when fluid pressure is low inside the pump to enable low surface tension and viscosity fluids to flow through said fluid flow control gap, and wherein applied fluid pressure by the subsurface oilfield pump liquid filling the pump volume during a pump downstroke within the column is of such magnitude as to prevent the subsurface oilfield liquid passing through said fluid control gap, and wherein said selective valve comprises a body, a housing provided at the top of said body, said housing having a communicating passage in the middle thereof for passing low surface tension and viscosity fluid, shells inside of said body having opposing contact surfaces, at least one of said contact surfaces being of a controlled surface roughness, said shells each additionally having a soft surface, said soft surfaces of said shells facing a corresponding seating surface of said housing, said seating surface of said housing forming a sealing surface with the soft surface of respective shells, and said body being provided with a central communicating passage open to the fluid compressed by the pump and in line with the contact surfaces between said shells and said communicating passage within said housing for passage of said low surface tension and viscosity fluid.

2. A selective valve to pass fluids as claimed in claim 1, wherein said shells are hollow half-shells, wherein orifices are provided within said hollow half-shells opening to said communicating passage and to the fluid compressed by the pump such that the pressure acting internally within the hollow half-shells provides sufficient force to press the contact surfaces of the half-shells against each other for selectively permitting passage of the low surface tension and viscosity fluids through said fluid flow control gap but preventing liquid passage therethrough.

3. A selective valve to pass fluids as claimed in claim 2, wherein the contact surface of said half-shells with said housing is formed by a half-shell wall which is soft, and wherein opposing walls between the shell halves which face each other are of such roughness, thickness and shape as to enable only gas to pass when subjected to fluid pressure of said subsurface oilfield pump fluid within the column.

* * * * *